US007543468B2

(12) United States Patent
Houlihan et al.

(10) Patent No.: US 7,543,468 B2
(45) **Date of Patent: *Jun. 9, 2009**

(54) LOCKING DEVICE AND METHOD FOR UNLOCKING THE LOCKING DEVICE

(75) Inventors: Kevin Houlihan, North Salem, NY (US); Patrick E. Wind, Darien, CT (US); Michael Gallo, Brookfield, CT (US)

(73) Assignee: Zephyr Lock LLC., Danbury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/036,442

(22) Filed: Feb. 25, 2008

(65) Prior Publication Data

US 2008/0141739 A1 Jun. 19, 2008

Related U.S. Application Data

(62) Division of application No. 11/322,171, filed on Dec. 29, 2005, now Pat. No. 7,353,673.

(51) Int. Cl.
*E05B 63/00* (2006.01)
*E05B 65/06* (2006.01)

(52) U.S. Cl. ..... 70/135; 70/84; 70/139; 70/448

(58) Field of Classification Search ..... 70/79, 70/83, 84, 135–137, 139, 350, 360, 361, 70/448

See application file for complete search history.

(56) References Cited

U.S. PATENT DOCUMENTS 1,507 A * 3/1840 Bosworth ..... 70/135
13,163 A * 7/1855 Field ..... 70/137
81,779 A * 9/1868 Hardy et al. ..... 70/139
2,097,504 A * 11/1937 Wells ..... 70/379 R
2,255,402 A * 9/1941 Vile ..... 70/139
2,437,299 A * 3/1948 Jacobi ..... 70/81
2,475,951 A * 7/1949 Floraday ..... 70/139
2,699,665 A * 1/1955 Pelle ..... 70/135
2,852,926 A * 9/1958 Chervenka ..... 70/379 R
3,176,487 A * 4/1965 Dauenbaugh ..... 70/139
3,465,557 A * 9/1969 Ryder ..... 70/139

(Continued)

*Primary Examiner*—Patricia L Engle
*Assistant Examiner*—Christopher Boswell
(74) *Attorney, Agent, or Firm*—Cantor Colburn LLP.

(57) ABSTRACT

A locking device and a method for unlocking the locking device are provided. The locking device includes a stationary plug having a first aperture extending therein configured to receive a key. The stationary plug further includes an outer surface, an inner surface defined by the first aperture, and at least a second aperture extending from the outer surface to the inner surface. The locking device further includes a housing having an outer wall disposed around at least a portion of the stationary plug. The outer wall has at least a third aperture extending therethrough. The locking device further includes a bolt member operably coupled to the outer wall of the housing. The locking device further includes a locking mechanism disposed in the third aperture of the housing and extending into the second aperture of the stationary plug. The locking mechanism is configured to allow rotation of the housing about the stationary plug when the key is inserted into the first aperture. The housing is configured to rotate from a first operational position to a second operational position in response to a force being applied to the bolt member.

7 Claims, 6 Drawing Sheets

U.S. PATENT DOCUMENTS 4,414,828 A * 11/1983 Takinami et al. ..... 70/379 R
4,494,781 A * 1/1985 Lafosse ..... 70/139
4,528,829 A * 7/1985 Bert et al. ..... 70/139
4,823,571 A * 4/1989 O'Gara ..... 70/139
6,389,857 B1 * 5/2002 Meekma et al. ..... 70/209
7,353,673 B2 * 4/2008 Houlihan et al. ..... 70/139

* cited by examiner

LOCKING DEVICE AND METHOD FOR UNLOCKING THE LOCKING DEVICE

CROSS REFERENCE TO RELATED APPLICATIONS

This application is a divisional application of U.S. Ser. No. 11/322,171, filed Dec. 29, 2005, which claims the benefit of U.S. Provisional application Ser. No. 60/640,396, filed Dec. 30, 2004, the contents of which are incorporated herein by reference thereto.

TECHNICAL FIELD

This application relates generally to a locking device that can be utilized by a physically disabled person and a method for utilizing the locking device.

BACKGROUND

Locking devices generally have a locking mechanism configured to receive a key. To unlock the locking device, an operator inserts a key into the locking mechanism and rotates the key to unlock the locking device. Alternately, combination locking devices can be utilized, but they still require the operator to perform rotational movements when turning a dial to specific numbers to unlock the locking device.

People with physical disabilities, however, often have difficulty in performing rotational movements with their hands, such as rotating a key or turning a dial. Thus, people with physical disabilities may be unable to unlock locking devices having the aforementioned features.

Therefore, it is desirable to provide a locking device that allows an operator to unlocking the locking device without having to perform rotational movements.

SUMMARY

A locking device utilizing a key in accordance with an exemplary embodiment is provided. The locking device includes a stationary plug having a first aperture extending therein configured to receive the key. The stationary plug further includes an outer surface, an inner surface defined by the first aperture, and at least a second aperture extending from the outer surface to the inner surface. The locking device further includes a housing having an outer wall disposed around at least a portion of the stationary plug. The outer wall has at least a third aperture extending therethrough. The locking device further includes a bolt member operably coupled to the outer wall of the housing. The locking device further includes a locking mechanism disposed in the third aperture of the housing and extending into the second aperture of the stationary plug. The locking mechanism is configured to allow rotation of the housing about the stationary plug when the key is inserted into the first aperture. The housing is configured to rotate from a first operational position to a second operational position in response to a force being applied to the bolt member.

A method of unlocking a locking device utilizing a key in accordance with another exemplary embodiment is provided. The locking device includes a stationary plug having a first aperture extending therein configured to receive the key, a housing having an outer wall disposed around at least a portion of the stationary plug, a bolt member coupled to the outer wall of the housing, and a locking mechanism operably coupled to the stationary plug and the outer wall. The method includes inserting the key into the first aperture of the stationary plug to induce the locking mechanism to rotatably release the housing from the stationary plug. The method further includes applying a force to the bolt member to induce the housing to rotate about the stationary plug from a first operational position to a second operational position.

DETAILED DESCRIPTION OF EXEMPLARY EMBODIMENTS

Figure 1:
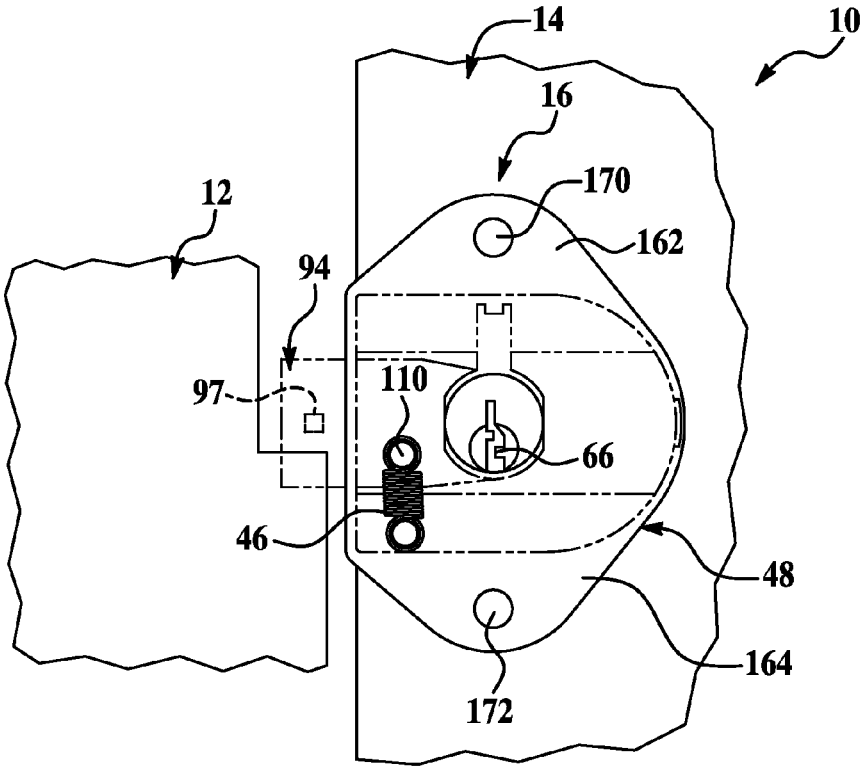
FIG. 1 is a front view of a portion of a locker door assembly having a locking device in a first locked operational position in accordance with an exemplary embodiment.
Figure 2:
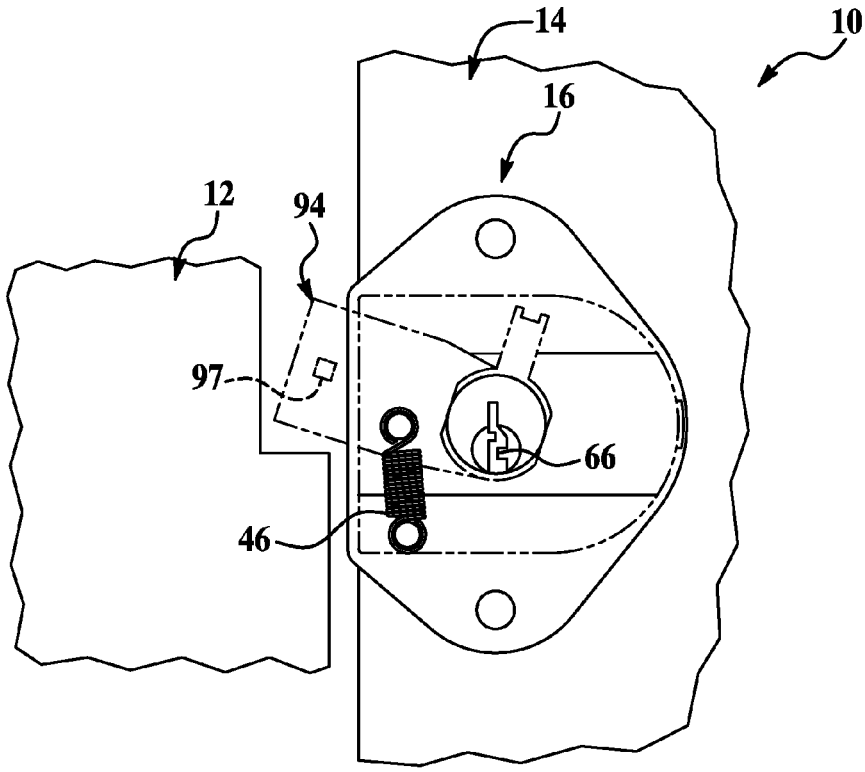
FIG. 2 is a front view of a portion of the locker door assembly of FIG. 1 having a locking device in a second unlocked operational position.

Referring to FIGS. 1 and 2, a locker door assembly 10 in accordance with an exemplary embodiment is illustrated. The locker door assembly 10 includes a locker door 14 having a locking device 16 that can lock the door 14 to a door frame 12. The locking device 16 is advantageously configured to allow a physically disabled person to lock and unlock the door 14 without having to turn a key. Referring to FIGS. 1, 3, 4, and 7, the locking device 16 includes a stationary plug 30, a housing 32, locking mechanisms 34, 36, 38, 40, a bolt member 94, an optional handle 97, a spring 46, an enclosure 48, and a key 50.

Figure 5:
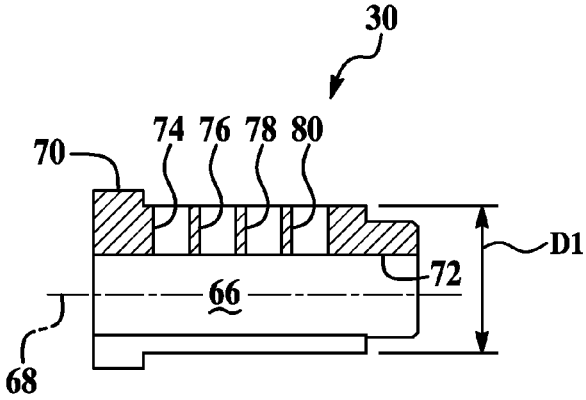
FIG. 5 is a sectional view of a stationary plug utilized in the locking device of FIG. 1.
Figure 6:
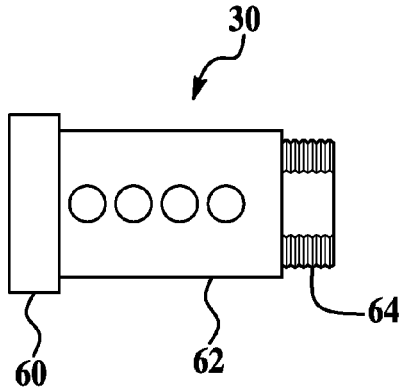
FIG. 6 is a top view of the stationary plug of FIG. 5.
Figure 8:
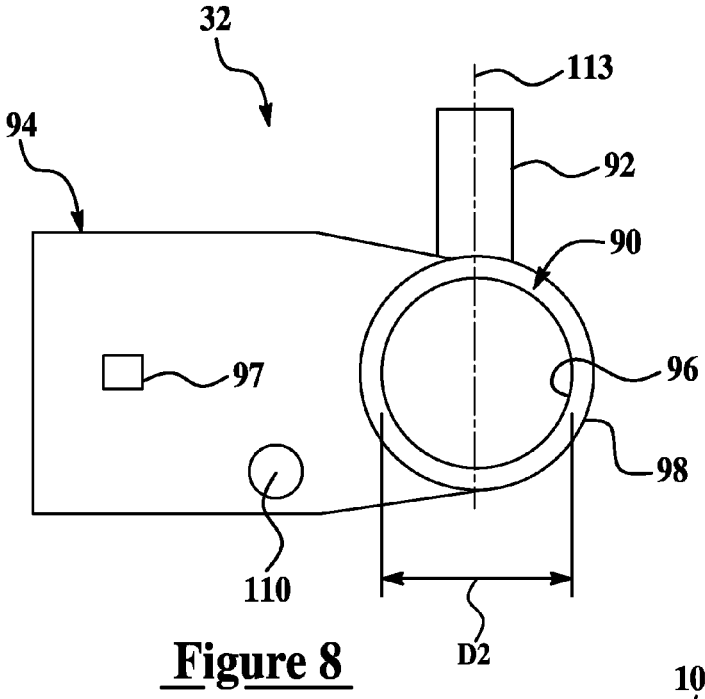
FIG. 8 is a front view of a housing utilized in the locking device of FIG. 1.

Referring to FIGS. 5 and 8, the stationary plug 30 is provided for receiving the key 50 therein. The stationary plug 30 is operably disposed within an aperture 96 of the housing 32. The stationary plug 30 has a generally cylindrical shape and has an aperture 66 extending therethrough along an axis 68. The aperture 66 is configured to receive the key 50. The stationary plug 30 is constructed from brass. Of course, the stationary plug 30 can be constructed from other metals or plastics or the like. The stationary plug 30 includes a cylindrical portion 62, a shoulder portion 60, and a threaded portion 64.

The cylindrical portion 62 has an outer diameter D1 that is less than or equal to a diameter D2 of the aperture 96 to allow the cylindrical portion 62 to be inserted within the aperture 96. The shoulder portion 60 is coupled to a first end of the cylindrical portion 62 and the threaded portion 64 is coupled to a second end of the portion 62. Further, the cylindrical portion 62 has apertures 74, 76, 78, 80 extending therethrough from an outer surface 70 to an inner surface 72 defined by the central aperture 66. The apertures 74, 76, 78, 80 are provided to receive portions of the locking mechanisms 34, 36, 38, 40, respectively, therein.

The shoulder portion 60 has a diameter greater than the diameter D1 of the portion 62 to allow the shoulder portion 62 to abut against an edge 33 of the housing 32 when the stationary plug 30 is inserted within the aperture 96 of the housing 32.

The threaded portion 64 is provided to allow the stationary plug 30 be fixedly attached to a nut 182 disposed proximate an edge 37 of the housing 32 for holding the stationary plug 30 within the aperture 96 of the housing 32. The threaded portion 64 includes a threaded outer surface whose diameter is smaller than the diameter D1 to threadably engage the nut 182. During assembly, the stationary plug 30 is inserted within the aperture 96 of the housing 32 such that the threaded portion 64 extends beyond the edge 37 of the housing 32 and the edge 41 of the enclosure 48. Thereafter, the nut 182 is threadably coupled to the threaded portion 64 proximate the edge 41.

Figure 9:
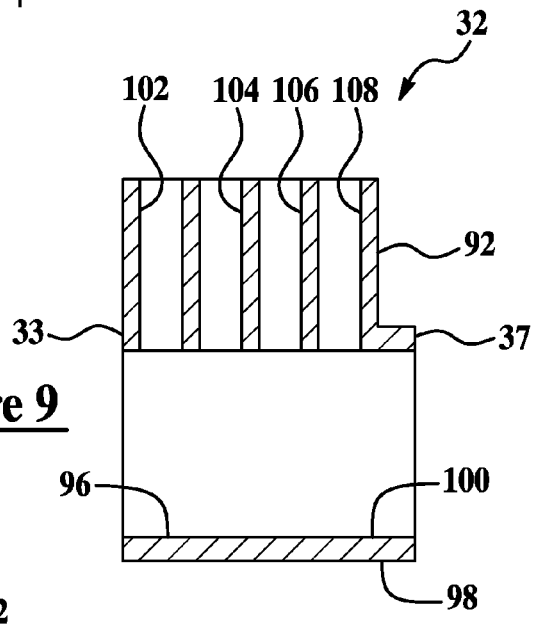
FIG. 9 is a side sectional view of the housing of FIG. 8.
Figure 10:
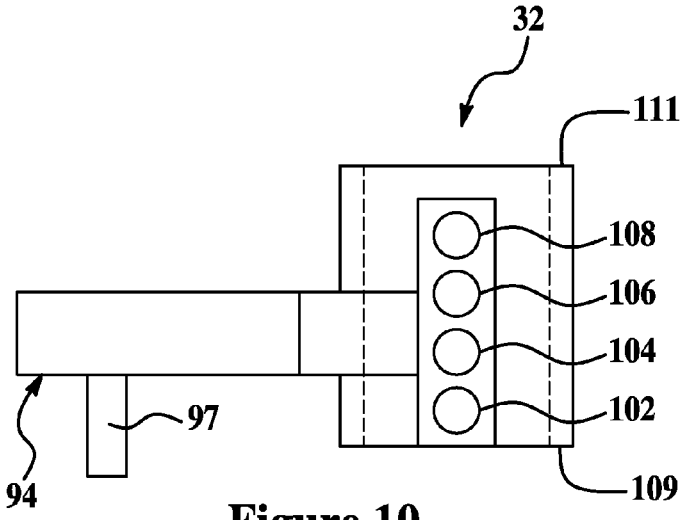
FIG. 10 is a top view of the housing of FIG. 8.

Referring to FIGS. 8, 9 and 10, the housing 32 is provided to rotate about the stationary plug 30 when the locking mechanisms 34, 36, 38, 40 have an unlocked configuration. The housing 32 is constructed from brass. Of course, the housing 38 can be constructed from other metals and plastics or the like. The housing 32 includes a tubular wall 90 and a locking mechanism enclosure 92.

The tubular wall 90 has an outer surface 98 and an inner surface 100. The tubular wall 90 further includes an aperture 96 extending therethrough for receiving the stationary plug 30 therein.

The locking mechanism enclosure 92 is coupled to a portion of the outer surface 98 of the tubular wall 90 and is provided to enclose locking mechanisms 34, 36, 38, 40 therein. The locking mechanism enclosure 92 includes apertures 102, 104, 106, 108 extending through the enclosure 92 and through the tubular wall 90. The apertures 102, 104, 106, 108 are utilized to receive the locking mechanisms 34, 36, 38, 40, respectively, therein. The apertures 102, 104, 106, 108 communicate with the aperture 96 extending through the tubular wall 90. Further, a diameter of the apertures 102, 104, 106, 108 in the enclosure 92 is substantially similar to a diameter of the apertures 74, 76, 78, 80, respectively, in the stationary plug 30. When the housing 32 is disposed at a first operational position, the apertures 102, 104, 106, 108 are aligned with the apertures 74, 76, 78, and 80, respectively in the stationary plug 30. Alternately, when the housing 32 is disposed at a second operational position, the apertures 102, 104, 106, 108 are not aligned with the apertures 74, 76, 78, 80, respectively.

The bolt member 94 is fixedly coupled to an outer surface 98 of the tubular wall 90. The bolt member 94 is constructed from steel and includes a bolt member 94 and a handle 97. Of course, the bolt member 94 can be constructed from other metals or plastics. The handle 97 extends outwardly from the bolt member 94 to allow a person to apply an upward or downward force to the bolt member 94 for rotating the bolt member 94, the tubular wall 90, and the locking mechanism enclosure 92, about the stationary plug 30. In particular, the bolt member 94 is disposed intermediate of ends 109, 111 of the housing 32 and extends in a direction generally perpendicular to an axis 113 extending through the locking mechanism enclosure 92. Thus, when a first tangential force is applied upwardly to the handle 97, and the key 50 is disposed within the stationary plug 30, the bolt member 94 rotates in a first rotational direction (e.g., clockwise direction in FIG. 8). Alternately, when a second tangential is applied downwardly to the handle 97, when the key 50 is disposed within the stationary plug 30, the bolt member 94 rotates in a second rotational direction (e.g., counterclockwise direction in FIG. 8). Referring to FIG. 1, the bolt member 94 abuts against a portion of the frame 12 when the locking device 16 is in a first operational position to prevent the door 14 from being opened outwardly from the frame 12. Alternately, when the bolt member 94 is rotated in a clockwise direction, the bolt member 94 is moved away from the frame 12 to allow the door 14 to be opened outwardly from the frame 12. Referring to FIGS. 1 and 8, the bolt member 94 includes an aperture 110 extending therethrough. As shown, a spring 46 is coupled to the bolt member 94 utilizing the aperture 110 and is further coupled to the enclosure 48. The spring 46 is provided to urge the bolt member 94 and the housing 32 to rotate in a second rotational direction (e.g. counterclockwise direction in FIG. 1) from an second operational position to the first operational position. In an alternate embodiment, the spring 46 can be coupled between the bar portion 97 and a portion of the locker door 14.

Figure 7:
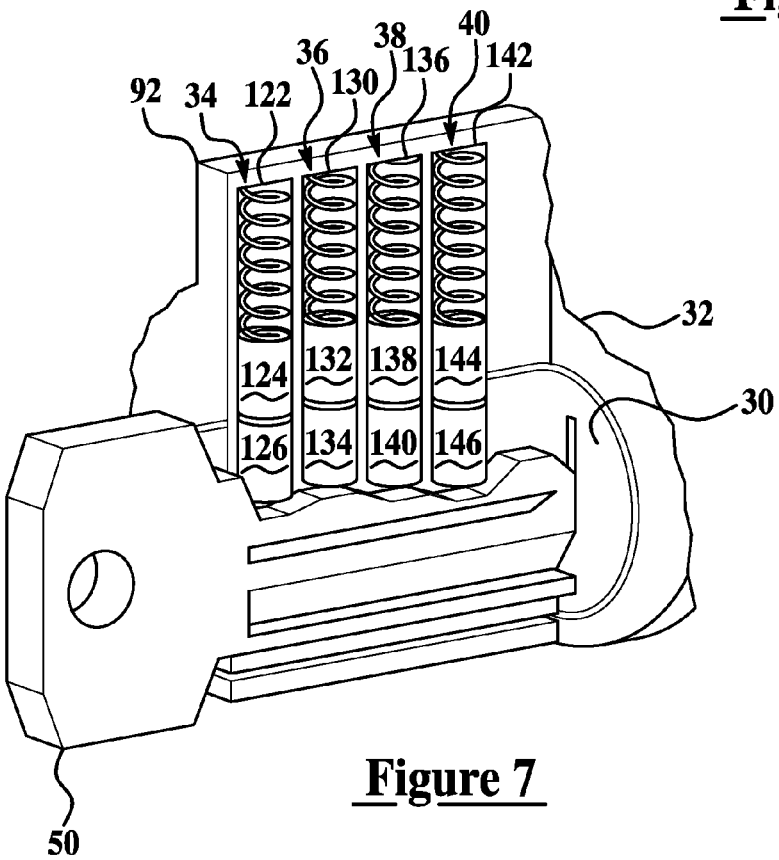
FIG. 7 is a partial assembly view of locking mechanisms utilized in the locking device of FIG. 1.

Referring to FIG. 7, the locking mechanisms 34, 36, 38, and 40 are provided to move to either a locked configuration or an unlocked configuration. In an unlocked configuration, the locking mechanisms 34, 36, 38, 40 allow the housing 32 to rotate relative to the stationary plug 30. In the locked configuration when the housing is disposed at the first operational position, the locking mechanisms 34, 36, 38, 40 prevent the housing 32 from rotating relative to the stationary plug 30.

Referring to FIGS. 7, 9, and 5, the locking mechanism 34 comprises a spring 122 and locking pins 124, 126. The spring 122 and locking pins 124, 126 are disposed within an aperture 102 in the locking mechanism enclosure 92. In particular, the spring 122 is provided to urge the locking pins 124, 126 toward the stationary plug 30. When the housing 32 is disposed at a first operational position, as shown in FIG. 1, with respect to the stationary plug 30, the aperture 102 is aligned with the aperture 74 of the plug 30. Thus, the spring 122 urges the locking pins 124, 126 toward the aperture 74 of the plug 30. When the key 50 is not disposed in the aperture 66 and the apertures 102 and 74 are aligned with one another, the locking pins 124, 126 are disposed in a locked configuration and do not allow the housing 32 to rotate relative to the plug 30. Alternately, when the key 50 is disposed in the aperture 66 the locking pins 124, 126 are disposed in an unlocked configuration and do not prevent the housing 32 from rotating relative to the plug 30.

The locking mechanism 36 comprises a spring 130 and locking pins 132, 134. The spring 130 and locking pins 132, 134 are disposed within an aperture 104 of the locking mechanism enclosure 92. In particular, the spring 130 is provided to urge the locking pins 132, 134 toward the stationary plug 30. When the housing 32 is disposed at the first operational position, as shown in FIG. 1, with respect to the stationary plug 30, the aperture 104 is aligned with the aperture 76 of the plug 30. Thus, the spring 122 urges the locking pins 132, 134 toward the aperture 76 of the plug 30. When the key 50 is not disposed in the aperture 66 and the apertures 104 and 76 are aligned with one another, the locking pins 132, 134 are disposed in a locked configuration and do not allow the housing 32 to rotate relative to the plug 30. Alternately, when the key 50 is disposed in the aperture 66 the locking pins 132 to 134 are disposed in an unlocked configuration and do not prevent the housing 32 from rotating relative to the plug 30.

The locking mechanism 38 comprises a spring 136 and locking pins 138, 140. The spring 136 and locking pins 138, 140 are disposed within an aperture 106 of the locking mechanism enclosure 92. In particular, the spring 136 is provided to urge the locking pins 138, 140 toward the stationary plug 30. When the housing 32 is disposed at the first operational position, as shown in FIG. 1, with respect to the stationary plug 30, the aperture 106 is aligned with the aperture 78 of the plug 30. Thus, the spring 136 urges the locking pins 138, 140 toward the aperture 78 of the plug 30. When the key 50 is not disposed in the aperture 66 and apertures 106 and 78 are aligned with one another, the locking pins 138, 140 are disposed in a locked configuration and do not allow the housing 32 to rotate relative to the plug 30. Alternately, when the key 50 is disposed in the aperture 66 the locking pins 138, 140 are disposed in an unlocked configuration and do not prevent the housing 32 from rotating relative to the plug 30.

The locking mechanism 40 comprises a spring 142 and locking pins 144, 146. The spring 142 and locking pins 144, 146 are disposed within an aperture 108 of the locking mechanism enclosure 92. In particular, the spring 142 is provided to urge the locking pins 144, 146 toward the stationary plug 30. When the housing 32 is disposed at the first operational position, as shown in FIG. 1, with respect to the stationary plug 30, the aperture 108 is aligned with the aperture 80 of the plug 30. Thus, the spring 142 urges the locking pins toward the aperture 80 of the plug 30. When the key 50 is not disposed in the aperture 66 and apertures 108 and 80 are aligned with one another, the locking pins 144, 146 are disposed in a locked configuration and do not allow the housing 32 to rotate relative to the plug 30. Alternately, when the key 50 is disposed in the aperture 66 the locking pins 144, 146 are disposed in an unlocked configuration and do not prevent the housing 32 from rotating relative to the plug 30.

Figure 3:
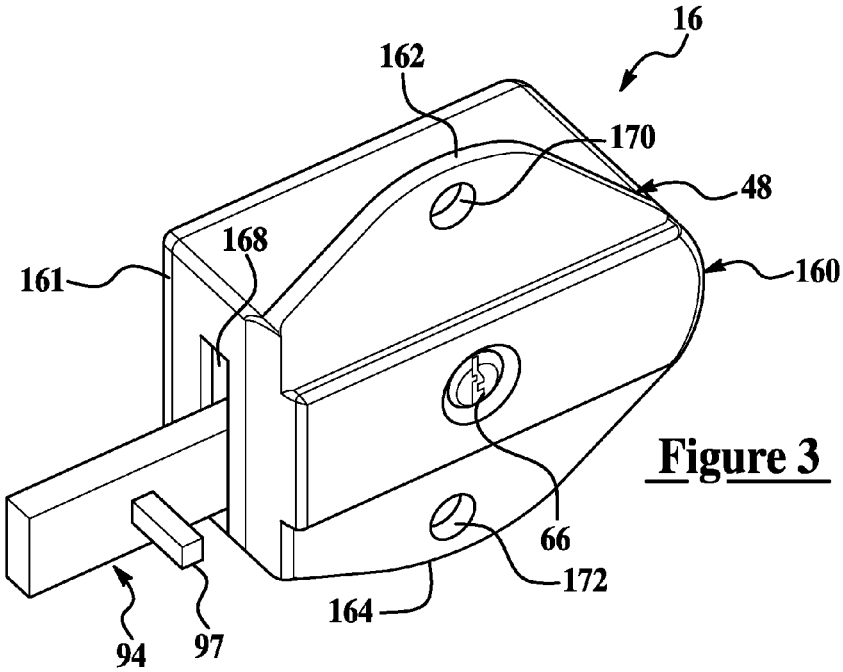
FIG. 3 is a perspective view of the locking device of FIG. 1.
Figure 4:
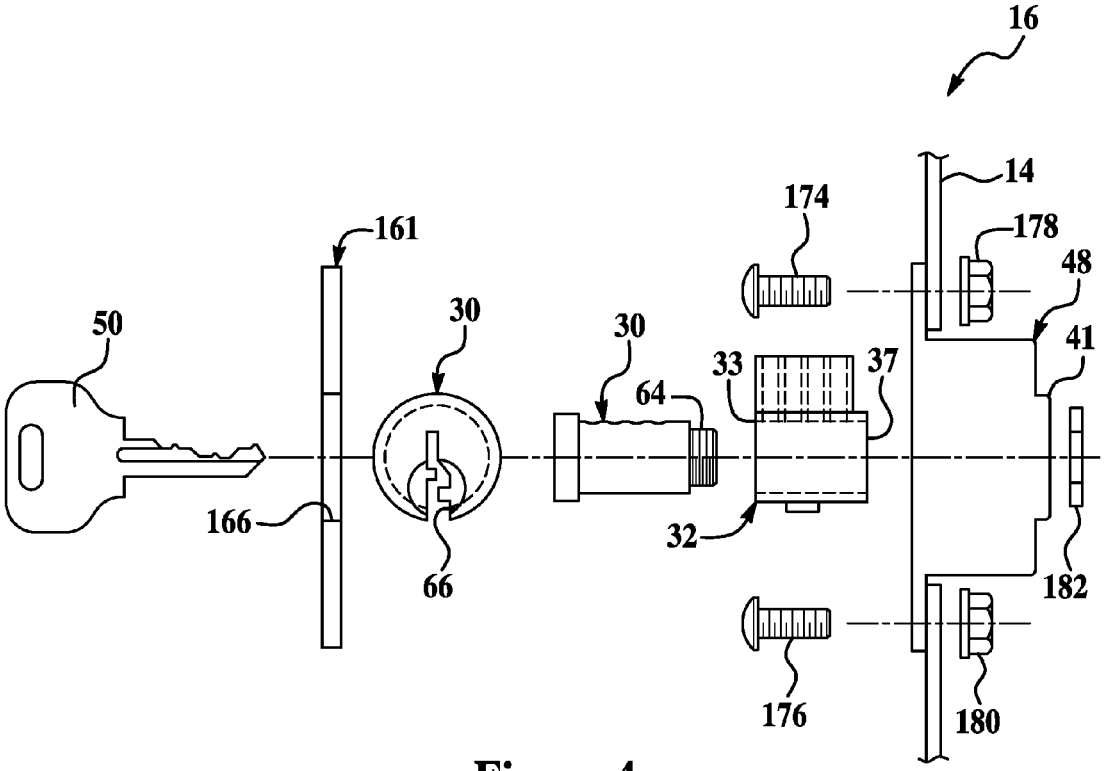
FIG. 4 is an exploded assembly view of the locking device of FIG. 1.

Referring to FIGS. 1, 3, and 4, the enclosure 48 is provided to enclose the components of the locking device 16. The enclosure 48 is constructed from a zinc die-cast alloy. Of course, the enclosure 48 can be constructed from other metals and plastics or the like. The enclosure 48 includes a central enclosure portion 160, a face-plate 161, a flange portion 162, a flange portion 164, bolts 174, 176, nuts 178, 180 and a plug mounting nut 182.

The central enclosure portion 160 and the face-plate 161 define an internal region configured to receive the stationary plug 30, the housing 32, and the locking mechanisms 34, 36, 38, 40. The face-plate 161 includes an aperture 166 extending therethrough to allow the stationary plug 30 to be accessed by the key 50. Further, the central enclosure portion 160 includes a slot 168 extending therethrough to allow the bolt member 94 to extend from the internal region of the enclosure portion 160 to a region outside of the enclosure portion 160.

The flange portions 162, 164 are fixedly coupled to opposite ends of the central enclosure portion 160. The flange portion 162 includes an aperture 170 extending therethrough. When mounting the enclosure 48 to the locker door 14, a bolt 174 is inserted through the aperture 170 and an opposite end of the bolt 174 is threadably coupled to the nut 178. The flange portion 164 includes an aperture 172 extending therethrough. When mounting the enclosure 48 to the locker door 14, a bolt 176 is inserted through the aperture 172 and an opposite end of the bolt 176 is threadably coupled to the nut 180.

Referring to FIGS. 1, 2, and 3, the operation of the locking device 16 will now be described. Initially, the locking device 16 is in a locked operational position wherein the bolt member 94 abutts against a portion of the frame 12 for preventing the locker door 14 from opening. Next, a person inserts the key 50 within the aperture 66 of the stationary plug 30. In response to the key 50, the locking mechanisms 34, 36, 38, 40 rotatably decouple the stationary plug 30 from the housing 32 to allow rotational movement of the housing 32 about the stationary plug 30. Next, the person applies an upward force to the member 97 to urge the bolt member 94 upwardly. The bolt member 94 induces the housing 32 to rotate about the stationary plug 30 from the first operational position to a second operational position. Next, the person rotates the locker door 14 away from the frame 12 to access an interior region of the locker. Next, the person rotates the locker door 14 toward the frame 12 and the spring 46 pulls the bolt member 94 downwardly to urge the bolt member 94 to rotate counter-clockwise to abut against a portion of the frame 12. Thereafter, the user removes the key 50 from the aperture 66 and the locking mechanisms 34, 36, 38, 40 couple the housing 32 to the stationary plug 30 to prevent rotational movement of the housing 32.

Figure 11:
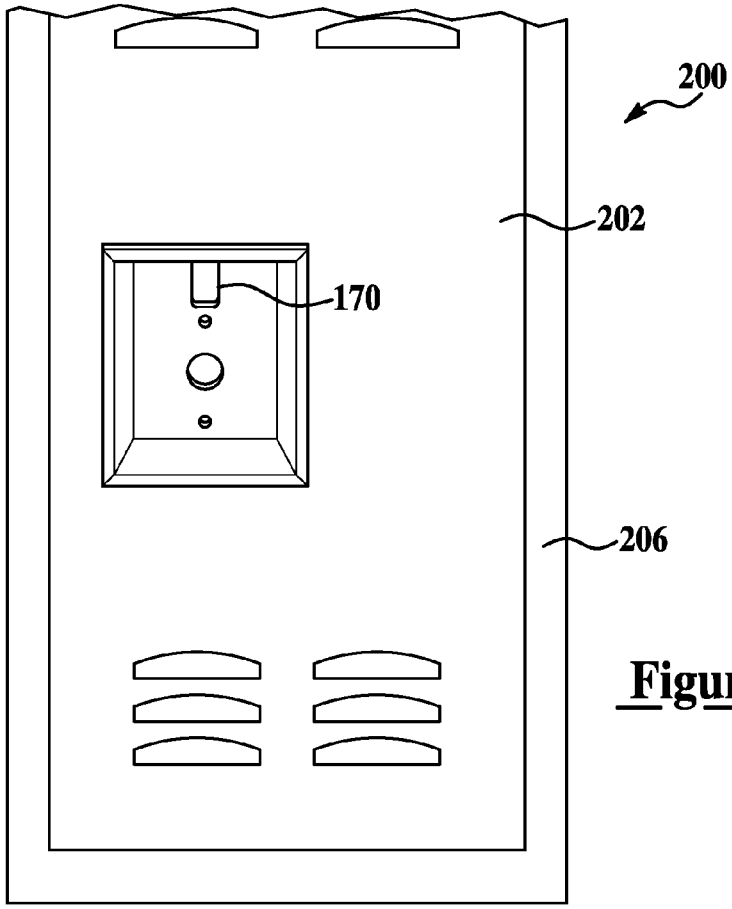
FIG. 11 is a front view of a locker door assembly in accordance with another exemplary embodiment.
Figure 12:
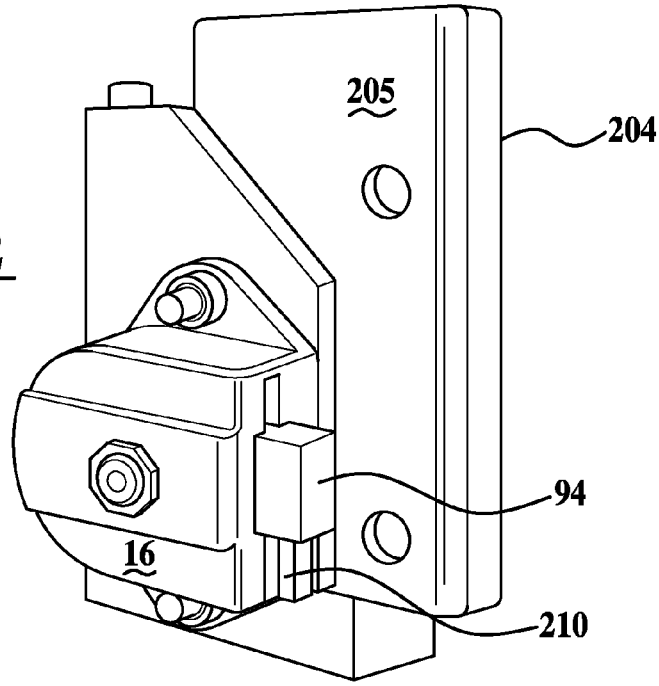
FIG. 12 is an enlarged rear view of the locking device utilized in the locker door assembly of FIG. 11.
Figure 13:
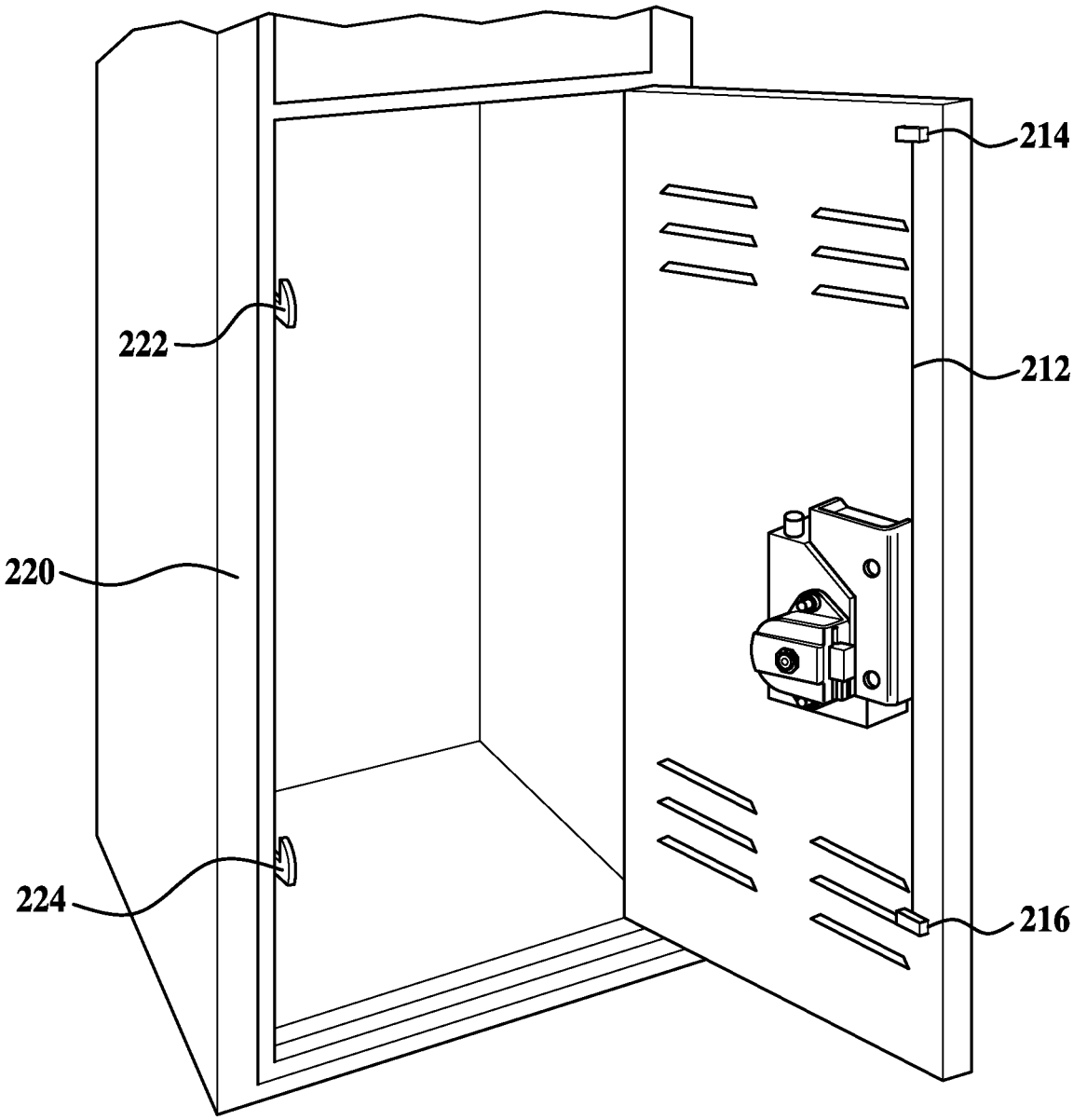
FIG. 13 is a rear view of the locker door assembly of FIG. 11.

Referring to FIGS. 11-13, a locker door assembly 200 in accordance with another exemplary embodiment is illustrated. The locker door assembly 200 includes a locker door 202, the locking device 16, a handle assembly 204, and a door frame 206. The locking device 16 is advantageously configured to allow a physically disabled person to lock and unlock the door 202 relative to the door frame 206.

The locking device 16, utilized in the locker door assembly 200 includes the stationary plug 30, the housing 32, locking mechanisms 34, 36, 38, 40, the bolt member 94, the spring 46, the enclosure 48, and the key 50. The locking device 16, utilized in the locker door assembly 200, does not include the optional handle 97.

The handle assembly 204 is provided to allow a person to latch and unlatch the locker door 202 from the door frame 206. The lift mechanism 204 is operably coupled to the locker door 202 proximate the locking device 16. The handle assembly 204 includes a handle 170, a tab portion 210 coupled to the handle 170, a body portion 205, a rod member 212, a latch member 214 and a latch member 216 disposed at opposite ends of the rod member 212. The handle 170 extends through an aperture of the locker door 202 and extends outwardly from a front surface of the locker door 202. The handle 170 is configured to allow person to move the tab 210 and the bolt member 94 upwardly to induce the rod member 212 to move upwardly, when the locking mechanisms 34, 36, 38, 40 are in an unlocked configuration. Alternately, when the locking mechanism 34, 36, 38, 40 are in a locked configuration, the bolt member 94 prevents the handle 170 and the tab 210 from being moved upwardly by the person.

During operation, when the rod member 212 is moved upwardly, the latch member 214 and the latch member 216 attached to the rod member 212, disengage from hasp or latching members 222, 224 fixedly attached to the housing 220 of the door frame 206. Next, the person can move the locker door 202 away from the door frame 206. Next, when the handle 170 is released by the person, the rod member 212 moves downwardly to an original start position. Further, the spring 46 induces the bolt member 94 to rotate to the first operational position with the locking mechanisms 34, 36, 38, 40 in an unlocked configuration. Next, the person can close the locker door 202 against the door frame and the lift mechanism 204 is spring-loaded to move the latch member 214 and the latch member 216 against the hasp members 222, 224, respectively to latch the locker door 202 to the door frame 206. Next, when the person removes the key 50 from the locking device 16, the locking mechanisms 34, 36, 38, 40 have a locked configuration at the first operational position of the housing 32 wherein the bolt member 94 is not allowed to rotate thus preventing the person from lifting the handle 170. Accordingly, the locker door 202 is locked against the door frame 206.

Although the locking device 16 has been described in connection with a locker door and a frame, it should be understood that that the locking device 16 can be utilized with other containers. For example, the locking device 16 can be utilized with a door in a home, a tool box, or a foot locker. The shape of the components of the locking device 16 can be adapted to suit the intended application. Further, the direction of rotation of the housing 32 and the handle portion can be adapted to suit the desired function and design of the locking device 16.

While the invention is described with reference to exemplary embodiments, it will be understood by those skilled in the art that various changes may be made and equivalence may be substituted for elements thereof without departing from the scope of the invention. In addition, many modifications may be made to the teachings of the invention to adapt to a particular situation without departing from the scope thereof. Therefore, it is intended that the invention not be limited to the embodiments disclosed for carrying out this invention, but that the invention includes all embodiments falling within the scope of the intended claims.

What is claimed is:

1. A locker system, comprising:

a locker;

a door pivotally mounted to the locker;

a locking device for locking the door to the locker, wherein the locking device does not require rotational movement of a key for unlocking the locking device, the locking device comprising:

a stationary plug fixedly secured to an enclosure of the locking device, the stationary plug having a first aperture extending therein, the first aperture being configured to receive the key;

a first plurality of apertures extending from an outer surface of the stationary plug into the first aperture;

an outer housing rotatably received about a portion of the stationary plug, the outer housing having a second plurality of apertures configured to align with the first plurality of apertures when the outer housing is in a first position with respect to the stationary plug;

a bolt member fixedly secured to and depending away from the outer housing; and a locking mechanism movably disposed in the first and second plurality of apertures, the locking mechanism extends into the first plurality of apertures when the rotatable housing is in the first position and the key is not inserted in the first aperture, wherein movement of the outer housing is prevented when the locking mechanism extends into the first plurality of apertures and wherein the locking mechanism retracts into the second plurality of apertures of the outer housing when the key is inserted in the first aperture and the outer housing is in the first position, wherein rotational movement of the outer housing about the stationary plug is allowed when the key is inserted in the first aperture, the outer housing being configured to rotate from the first position to a second position in response to a force being applied to the bolt member and without rotational movement of the key and the stationary plug; and wherein the stationary plug is fixedly secured to the enclosure and the enclosure is fixedly secured to the locker.

2. The locker as in claim 1, wherein the outer housing is biased into the first position by a spring fixedly secured to the bolt member at one end and the enclosure at the other end.

3. The locker as in claim 2 wherein the outer housing further comprises a locking mechanism enclosure, the locking mechanism enclosure having the second plurality of apertures of the outer housing disposed therein and wherein the locking mechanism comprises a first plurality of pins and a second plurality of pins, the first plurality of pins being disposed in the first plurality of apertures of the stationary plug and the second plurality of pins being disposed in the second plurality of apertures of the locking mechanism enclosure, wherein the second plurality of pins are spring biased towards the first plurality of pins and wherein the locking mechanism enclosure protrudes outwardly from the outer housing and the locking mechanism enclosure rotates with the outer housing, wherein the locking mechanism does not contact any other components of the locking device as the outer housing rotates from the first position to the second position.

4. The locker as in claim 1, wherein the locker further comprises a pair of hasp members configured to engage latch members secured to the outer housing.

5. The locker as in claim 4, wherein the latch members are secured to the outer housing by a rod member.

6. A method of unlocking a locking device of a locker, the method comprising:

inserting a key into a stationary plug of the locking device, the stationary plug being fixedly secured to an enclosure of the locking device;

rotating an outer housing rotatably received about a portion of the stationary plug without rotating the key or the stationary plug, wherein a bolt secured to the outer housing is moved from a locking position to a non-locking position; and biasing the outer housing into the locking position by a spring secured to the bolt at one end and the enclosure at the other end.

7. The method as in claim 6, wherein the outer housing is moved from the locking position to the non-locking position by a force that overcomes the biasing force of the spring.

* * * * *